US012768599B2

(12) United States Patent
Mucenieks

(10) Patent No.: US 12,768,599 B2
(45) Date of Patent: Oct. 20, 2026

(54) ADIABATIC PRE-COOLING SYSTEM FOR V-TYPE AIR COOLED HEAT EXCHANGER

(71) Applicant: Janis Strelits-Strele, Dubai (AE)

(72) Inventor: Armands Mucenieks, Ogre (LV)

( * ) Notice: Subject to any disclaimer, the term of this patent is extended or adjusted under 35 U.S.C. 154(b) by 0 days.

(21) Appl. No.: 18/862,536

(22) PCT Filed: Apr. 27, 2023

(86) PCT No.: PCT/LV2023/050009

§ 371 (c)(1),
(2) Date: Nov. 3, 2024

(87) PCT Pub. No.: WO2023/214866

PCT Pub. Date: Nov. 9, 2023

(65) Prior Publication Data

US 2025/0277628 A1 Sep. 4, 2025

(30) Foreign Application Priority Data

May 2, 2022 (LV) ..... P2022000038

(51) Int. Cl.
*F28C 1/14* (2006.01)
*F28C 3/08* (2006.01)
(Continued)

(52) U.S. Cl.
CPC ..... *F28C 1/14* (2013.01); *F28C 3/08* (2013.01); *F28D 1/024* (2013.01); *F28D 5/02* (2013.01); *F28F 25/06* (2013.01)

(58) Field of Classification Search
CPC .... F28C 1/14; F28C 3/08; F28D 1/024; F28D 5/02; F28F 25/06
(Continued)

(56) References Cited

U.S. PATENT DOCUMENTS 3,384,165 A * 5/1968 Mathews ..... F28D 5/02 D23/314
10,365,053 B2 * 7/2019 Billings ..... F28G 15/003
(Continued)

FOREIGN PATENT DOCUMENTS

EP 2696159 A1 2/2014
EP 3143358 A1 3/2017
(Continued)

OTHER PUBLICATIONS

PCT International Report; May 2, 2022.
(Continued)

*Primary Examiner* — Claire E Rojohn, III
(74) *Attorney, Agent, or Firm* — Patshegen IP; Moshe Pinchas

(57) ABSTRACT

An improved adiabatic pre-cooling system for a V-type air cooled heat exchanger. The system includes an adiabatic panel (5) arranged in front of an air inlet area (2) of the V-type air cooled heat exchanger (1) and a water spraying unit (10) arranged in front of the adiabatic panel (5). The water spraying unit (10) includes a horizontal water spraying sub-unit (11) and two vertical water spraying sub-units (12) connected to the horizontal water spraying sub-unit (11). Each water spraying sub-unit (11; 12) includes nozzles (22). The nozzles (22) on the vertical water spraying sub-unit (12) are arranged so that water from the nozzles (22) is sprayed parallel to the adiabatic panel (5). The nozzles (22) on the horizontal water spraying sub-unit (11) are arranged so that water from the nozzles (22) is sprayed longitudinal to a direction of the incoming air flow (A).

9 Claims, 7 Drawing Sheets

(51) Int. Cl.
*F28D 1/02* (2006.01)
*F28D 5/02* (2006.01)
*F28F 25/06* (2006.01)

(58) Field of Classification Search
USPC ..... 165/165
See application file for complete search history.

(56) References Cited

U.S. PATENT DOCUMENTS

| | | | | |
|---|---|---|---|---|
| 10,788,268 | B2 * | 9/2020 | Byrne | F28F 13/003 |
| 10,852,079 | B2 * | 12/2020 | Curtis | F28C 1/02 |
| 11,365,938 | B2 * | 6/2022 | Strumenti | F28D 5/02 |
| 11,384,529 | B2 * | 7/2022 | Johnson | B65D 88/005 |
| 11,493,289 | B1 * | 11/2022 | Maisey | F28F 21/067 |
| 11,844,541 | B2 * | 12/2023 | Childers, Jr. | F28F 25/04 |
| 12,287,120 | B2 * | 4/2025 | Benedetti | F24F 13/30 |
| 12,298,092 | B2 * | 5/2025 | Stewart | B08B 3/02 |
| 12,419,661 | B2 * | 9/2025 | Childers, Jr. | A61B 17/30 |
| 2006/0005563 | A1 * | 1/2006 | Carter | F28B 1/02 62/310 |
| 2007/0101746 | A1 * | 5/2007 | Schlom | F24F 1/0059 62/332 |
| 2010/0242516 | A1 * | 9/2010 | Seo | F28C 1/16 165/96 |
| 2014/0041834 | A1 * | 2/2014 | Kloeppner | F28F 1/00 165/104.13 |
| 2015/0204626 | A1 * | 7/2015 | Martell | F28C 1/14 165/200 |
| 2015/0276292 | A1 * | 10/2015 | Son | F28C 1/00 62/135 |
| 2016/0252313 | A1 * | 9/2016 | Ziegltrum | F28D 5/02 165/301 |
| 2017/0074553 | A1 * | 3/2017 | Dinnage | F25B 49/00 |
| 2017/0082370 | A1 * | 3/2017 | Strumenti | F28C 3/08 |
| 2018/0094884 | A1 * | 4/2018 | Rousselet | F28C 1/00 |
| 2018/0231264 | A1 | 8/2018 | Evapco | |
| 2019/0107332 | A1 * | 4/2019 | Rede | F24F 6/14 |
| 2019/0309966 | A1 * | 10/2019 | Klaba | F28C 1/14 |
| 2021/0180891 | A1 * | 6/2021 | Rousselet | F24F 11/70 |
| 2021/0254898 | A1 * | 8/2021 | Byrne | F28B 1/06 |
| 2021/0356221 | A1 * | 11/2021 | Blay | F28C 1/14 |
| 2022/0316826 | A1 * | 10/2022 | Wright, Jr. | F28C 1/14 |
| 2023/0184219 | A1 * | 6/2023 | Choi | F03D 9/00 415/121.3 |
| 2024/0115284 | A1 * | 4/2024 | Childers, Jr. | A61B 17/30 |
| 2024/0344720 | A1 * | 10/2024 | Bittner | F28B 9/04 |
| 2025/0339807 | A1 * | 11/2025 | Oseen-Senda | B01D 53/0454 |

FOREIGN PATENT DOCUMENTS

| | | | |
|---|---|---|---|
| EP | 3671090 | | 6/2020 |
| WO | 2005005905 | A1 | 1/2005 |
| WO | 2020228474 | A1 | 11/2020 |

OTHER PUBLICATIONS

Smart Cooling: New Generation Chiller Boosting Adiabatic Pre-Cooling System Brochure, Swiss Integrated Energy.

Smart Cooling, Case Study: Hilton hotel - Dubai, Swiss Integrated Energy Technologies AG, Sep. 2020.

Smart Cooling, 'How it works', Wayback Machine capture dated Sep. 25, 2021, from.

How mist affect the chiller performance and electricity consumption; https://www.youtube.com/watch ?= SMgVY38VcUM 19.

What is chiller pre-cooling; https://www.youtube.com/watch?v= ml96GeXC8s Jun. 7, 2021.

Smart Cooling Adiabatic Precooling System—Carrier 30XA chillers—Greenhouse project in Al Ain UAE Video uploaded by Smart Cooling to YouTube at link https://www.youtube.com/watch?v= DIG-cK Lqty Sep. 13, 2021.

Gerab Energy Systems Llc; https://www.youtube.com/watch?v= 79JhTI81sAU Aug. 1, 2018.

Intelligent Adiabatic Cooling System "Smart Cooling" at Rose Park Hotel_2; https://www.youtube.com/watch?

Adiabatic Cooling System |New Generation Intelligent Adiabatic Cooling System (IACS) ™ Video uploaded by EnerGeo™ to YouTube at link.

Blue Energy—Smart Cooling 003 Video uploaded by Blue Energy Italy to YouTube at link https://www.youtube.com/watch?v=fdZRfeHEw80 Sep. 28, 2016.

Blue Energy—Smart Cooling system 002 Video uploaded by Blue Energy Italy to YouTube at link https://www.youtube.com/watch?v=W1Gz3yooop4.

Smart Cooling Adiabatic Precooling System—McQuay chillers—Datacentre D'li project in Dubai, UAE https://www.youtube.com/watch?v =- QYOsAJWz68.

Adiabatic cooling chiller booster Smart Cooling PRO10. https://www.youtube.com/watch?v=lleQK6CD87E&t=8s.

Blue Energy—Smart Cooling system 001 https://www.youtube.com/watch?V=1HA3RsjbQ11.

Intelligent Adiabatic Pre-Cooling System at Rose Park Hotel _1 https://www.youtube.com/watch?v=t35zXzf8MKE.

Smart Cooling™' is a New Generation Intelligent Adiabatic Pre-Cooling. Video uploaded by Gerab Energy Systems LLC to YouTube. https://www.youtube.com/watch?v=TFyeM6TRdFI.

Double Tree Hilton a I Barsha. Smart Cooling operational on Carrier 30XA Chiller Video uploaded by Smart Cooling to YouTube at link.

Carrier, Aquaforce 30XA/XQ Air-Cooled Liquid Chiller Reversible Air-to-Water Heat Pump, CAT_30XAXQ_E-1911_07, Nov.

Swiss Integrated Energy Technologies, Test Report No. 45: Chiller Efficiency Performance with Intelligent Adiabatic Chiller-Boosting Smart Cooling Pro 10 System, Jul. 31, 2019, 16 pages.

* cited by examiner

ADIABATIC PRE-COOLING SYSTEM FOR V-TYPE AIR COOLED HEAT EXCHANGER

FIELD OF THE INVENTION

The present invention concerns an improved adiabatic pre-cooling system, especially the adiabatic pre-cooling system for V-type air cooled heat exchanger.

BACKGROUND OF THE INVENTION

Conventional cooling systems such as heating, ventilation, and air conditioning (HVAC) systems are used around the world to regulate and control the temperature and humidity of a room or space, providing fresh and/or filtered air.

Some typical examples of air cooled heat exchangers with adiabatic cooling are disclosed in the European patent application publication No. EP3671090, Chinese patent application publications Nos. CN10520291 and CN105157447.

V-shaped or V-type air cooled heat exchangers with adiabatic pre-cooling are disclosed in the US patent application publication No. US2018/0231264, and the international application publications Nos. WO2017/082714 and WO2019/060463. The US patent application publication No. US2018/231264 discloses a once-through dry adiabatic cooler having a water distribution system, a wastewater sensor, and a controller, where the amount of wastewater, is detected, and the amount of water distributed to an air flow path adjacent to the coils of the cooler is adjusted so that the amount of water detected is as close to zero as possible, or, in the case of the use of adiabatic pads that require flushing, only the amount of water necessary to flush salt and other minerals from said pads.

Cooling units consume vast amounts of energy. Supplying power to a cooling unit is often costly and has environmental implications. Cooling units exploiting adiabatic cooling require a continuous supply of water, in a result of which large volumes of water are consumed as part of the cooling process.

Hence it is necessary to decrease water consumption without sacrificing cooling efficiency. One way of decreasing water consumption is by utilizing various sensor and control systems as disclosed in European patent application publication No. EP3671090. This increases the complexity of the system and the possibility of down-time due to some electronic fault.

Moreover, it is not very effective in environments where constant cooling has to be provided as the system is always ON and no water and energy reduction can be obtained.

It is an object of the invention to reduce the energy consumption of cooling units whilst minimizing water consumption overcoming aforementioned drawbacks.

SUMMARY OF THE INVENTION

Aforementioned drawbacks are overcome, and aims are reached by a design of an adiabatic pre-cooling system with V-type air cooled heat exchangers. The V-type air cooled heat exchanger may be an air conditioner, chiller, or refrigeration unit. The V-type air cooled heat exchanger comprises two air inlet areas arranged in V-type configuration to each other, an air outlet arranged above two air inlet areas, and at least one fan configured to provide an air flow from the air inlet area to the air outlet.

The adiabatic pre-cooling system comprises an adiabatic panel arranged in front and in parallel to the air inlet area of the V-type air cooled heat exchanger so that the incoming air flow first flows through the adiabatic panel and then through the air inlet area of the V-type air cooled heat exchanger into the V-type air cooled heat exchanger. The adiabatic panel has a lower edge, an upper edge, and side edges. The adiabatic panels are arranged so that it covers the air inlet area. One design of the adiabatic panels is disclosed in the European patent publication No. EP3098558.

The adiabatic pre-cooling system comprises a water spraying unit arranged in front of the adiabatic panel. The water spraying unit comprises a horizontal water spraying sub-unit arranged at the lower edge of the air inlet area and two vertical water spraying sub-units arranged on each end of the horizontal water spraying sub-unit and at the side edges of the adiabatic panel. Moreover, the horizontal water spraying sub-unit and two vertical water spraying sub-units are arranged parallel to the adiabatic panel. The horizontal water spraying sub-unit is fluidly connected to the vertical water spraying sub-units.

Each water spraying sub-unit comprises a nozzle pipe, a nozzle pipe enclosure partly enclosing said nozzle pipe, an enclosure cover joined with the nozzle pipe enclosure fully enclosing said nozzle pipe, and at least two nozzles installed on said nozzle pipe. The nozzles on the vertical water spraying sub-unit are arranged so that water from the nozzles is sprayed parallel to the adiabatic panel and the nozzles on the horizontal water spraying sub-unit are arranged so that water from the nozzles is sprayed longitudinal to a direction of the incoming air flow and in an opposite direction to the incoming air flow. In other words, the nozzles on the horizontal water spraying sub-unit are configured so that the water can be sprayed in the range from a longitudinal direction to a direction of the incoming air flow to a parallel direction to the adiabatic panel.

The horizontal water spraying sub-unit may comprise 6 to 12 nozzles. In one embodiment of the invention the horizontal water spraying sub-unit comprises 8 nozzles. The vertical water spraying sub-unit may comprise from 2 to 5 nozzles. In one embodiment of the invention the vertical water spraying sub-unit comprises 5 nozzles and 6 to 12 nozzles on the horizontal water spraying sub-unit. In another embodiment of the invention the horizontal water spraying sub-unit comprises 8 nozzles and the vertical water spraying sub-unit comprises 5 nozzles. Moreover, the nozzles may be arranged so that the distance between the nozzles of the horizontal water spraying sub-unit is generally equal to the distance between the nozzles of the vertical water spraying sub-unit.

Each nozzle has an opening for water spraying. The opening of the nozzle may be adjusted in the range of 15 to 40 microns.

The adiabatic pre-cooling system comprises water management unit fluidly connected to the water spraying unit. The water management unit comprises a water inlet filtration module for filtration of incoming water in the system, an UV and antiscale module fluidly connected to the water inlet filtration module and configured to UV treat and antiscale the water, a high pressure pump fluidly connected to the UV and antiscale module and configured to supply the water to the water spraying unit via a high pressure line. Water pressure generated by the high pressure pump is in a range of 60 to 100 bar. The water management unit further comprises a drainage configured to collect non-evaporated water, and a recirculating module with a booster pump fluidly connected to the drainage and configured to pump the water from the drainage to the inlet filtration module. The water management unit further comprises an auxiliary filtration module fluidly connected to the recirculating module with the booster pump and the UV and antiscale module. The auxiliary filtration module is configured to filtrate the water incoming from the drainage.

Aforementioned adiabatic pre-cooling system with V-type air cooled heat exchangers provide effective pre-cooling of incoming air while being compact and within the design volume of the V-type air cooled heat exchanger. No need for the design of additional space for adiabatic pre-cooling and easy refit or update of existing V-type air cooled heat exchangers with adiabatic pre-cooling system.

BRIEF DESCRIPTION OF THE DRAWINGS

The drawings illustrate, by way of example, but not by way of limitation, various embodiments of the invention.

DETAILED DESCRIPTION OF THE EMBODIMENTS

The preferred embodiments of the invention are now described with reference to the figures to illustrate objectives, advantages, and efficiency of the present invention.

Figure 1:
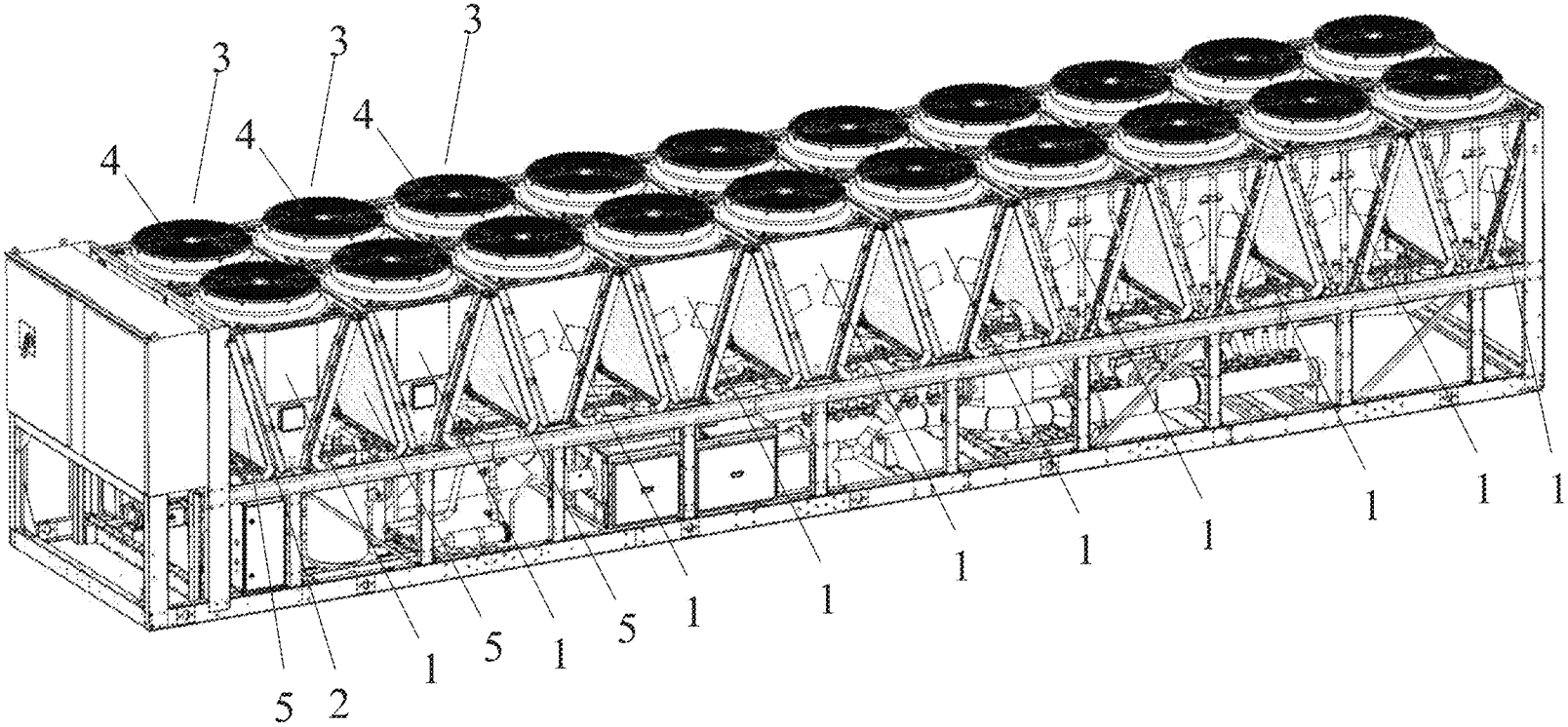
FIG. 1 is a perspective view of 10 V-type air cooled heat exchangers with installed adiabatic pre-cooling system.

FIG. 1 is perspective view of 10 V-type air cooled heat exchangers (1) with an installed adiabatic pre-cooling system. Each V-type air cooled heat exchanger (1) comprises two air inlet areas (2) arranged in V-type configuration to each other, an air outlet (3) arranged above two air inlet areas (2) and at least one fan (4) configured to provide an incoming air flow (A in FIG. 2) to the air inlet area (2) and out-coming air flow (B in FIG. 2) from the air outlet (3). The air inlet areas (2) are covered by adiabatic panels (5) so that these air inlet areas (2) are not really seen in FIG. 1 as it is seen in FIG. 2.

Figure 2:
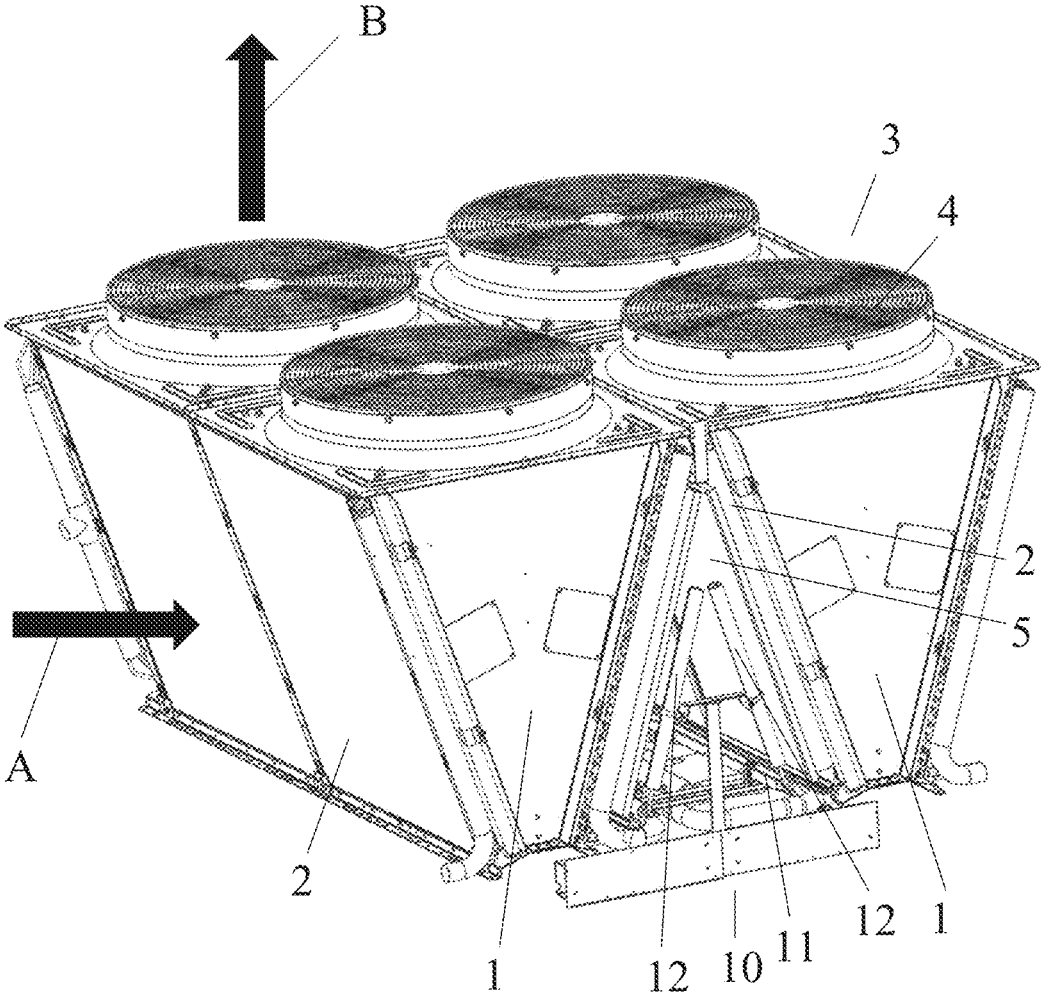
FIG. 2 is a perspective view of 2 V-type air cooled heat exchangers with installed adiabatic pre-cooling system.

FIG. 2 is a perspective view of 2 V-type air cooled heat exchangers (1) with installed adiabatic pre-cooling system. This is a typical arrangement of two V-type air cooled heat exchangers (1) where the heat exchangers (1) form a triangular volume therebetween or between the opposed air inlet areas (2) of adjacent V-type air cooled heat exchangers (1). The air inlet area (2) is covered by the adiabatic panel (5). The adiabatic panel (5) is arranged in front and parallel to the air inlet area (2) of the V-type air cooled heat exchanger (1) so that the incoming air flow (A) first flows through the adiabatic panel (5) and then through the air inlet area (2) of the V-type air cooled heat exchanger (1) into the V-type air cooled heat exchanger (1). The adiabatic pre-cooling system comprises a water spraying unit (10) arranged in front of the adiabatic panel (5) and within the triangular volume formed between two adjacent V-type air cooled heat exchangers (1). In FIG. 2 the water spraying unit (10) is arranged within the triangular volume. The water spraying unit (10) comprises a horizontal water spraying sub-unit (11) arranged at a lower edge of the air inlet area (2) and the adiabatic panel (5), and two vertical water spraying sub-units (12) arranged on each end of the horizontal water spraying sub-unit (11) and fluidly connected thereto. The horizontal water spraying sub-unit (11) and two vertical water spraying sub-units (12) are arranged parallel to the adiabatic panel (5).

Figure 3:
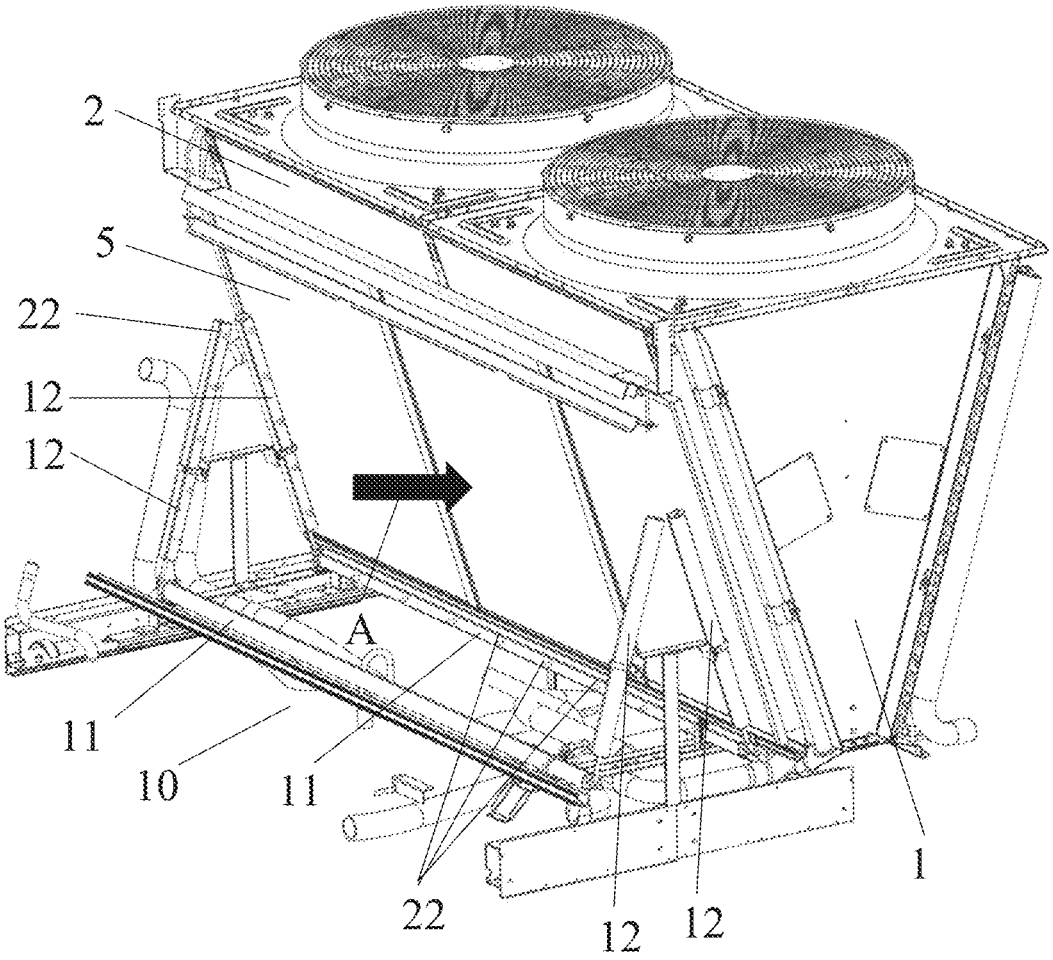
FIG. 3 is a perspective view of a V-type air cooled heat exchanger with an installed adiabatic pre-cooling system. Adjacent V-type air cooled heat exchanger as seen in FIG. 2 is removed from this Figure allowing to show the adiabatic pre-cooling system in more detail.

FIG. 3 is a perspective view of a V-type air cooled heat exchanger (1) with an installed adiabatic pre-cooling system. The adjacent V-type air cooled heat exchanger as seen in FIG. 2 is removed from this FIG. 3 allowing to show the adiabatic pre-cooling system in more detail. The water spraying unit (10) is arranged in front of the adiabatic panel (5). The horizontal water spraying sub-unit (11) is arranged at a lower edge of the air inlet area (2), and two vertical water spraying sub-units (12) are arranged on each end of the horizontal water spraying sub-unit (11) and fluidly connected thereto. The horizontal water spraying sub-unit (11) and two vertical water spraying sub-units (12) are arranged parallel to the adiabatic panel (5). The horizontal water spraying sub-unit (11) comprises 8 nozzles (22), and each vertical water spraying sub-units (12) comprises 5 nozzles (22). The nozzles (22) on the vertical water spraying sub-unit (12) are arranged so that water from the nozzles (22) is sprayed parallel to the adiabatic panel (5). The nozzles (22) on the horizontal water spraying sub-unit (11) are arranged so that water from the nozzles (22) is sprayed substantially longitudinal to a direction of the incoming air flow (A). In other embodiments the nozzles (22) of the horizontal water spraying sub-unit (11) can be turned towards the adiabatic panel (5). The position of the nozzles (22) of the horizontal water spraying sub-unit (11) is adjusted according to the power of the V-type air cooled heat exchanger.

Figure 4:
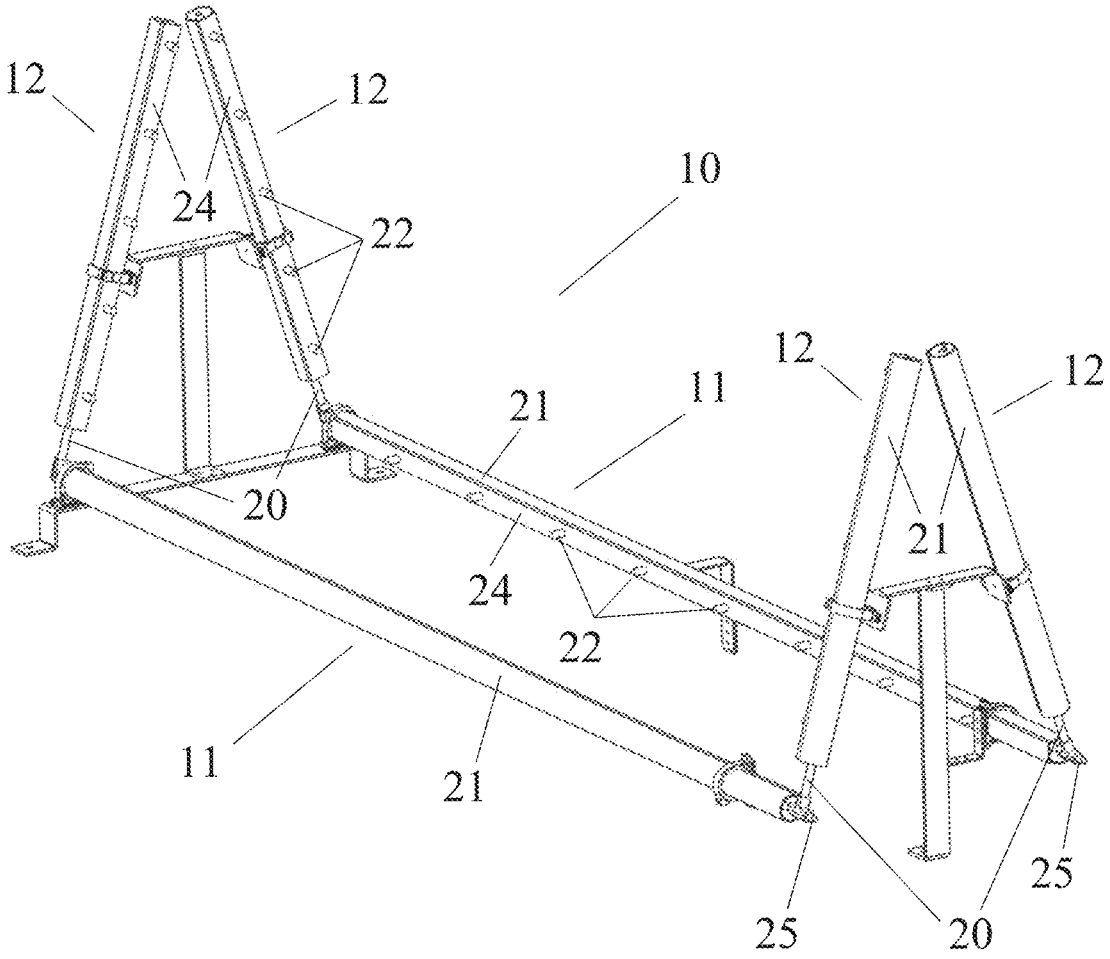
FIG. 4 is a perspective view of a nozzle and piping system of an adiabatic pre-cooling system.

FIG. 4 is a perspective view of a nozzle and piping system of two water spraying units (10) of the adiabatic pre-cooling system as seen in FIGS. 1 to 3. Two water spraying units (10) are configured to be arranged within the triangular volume between the adjacent V-type air cooled heat exchangers (1). Each water spraying unit (10) comprises the horizontal water spraying sub-unit (11) and two vertical water spraying sub-unit (12) arranged on each end of the horizontal water spraying sub-unit (11). Each water spraying sub-unit (11; 12) comprises a nozzle pipe (20), a nozzle pipe enclosure (21) partly enclosing said nozzle pipe (20), an enclosure cover (24) joined with the nozzle pipe enclosure (21) fully enclosing said nozzle pipe (20). The horizontal water spraying sub-unit (11) comprises 8 nozzles (22) and each vertical water spraying sub-units (12) comprises 5 nozzles (22). The nozzles (22) of one vertical water spraying sub-unit (12) are opposed to the nozzles (22) of another vertical water spraying sub-unit (12). The nozzles (22) of horizontal water spraying sub-unit (11) of one water spraying unit (10) are opposed to the nozzles (22) of horizontal water spraying sub-unit (11) of adjacent water spraying unit (10). The water spraying unit (10) is connected to a water supply system through its connection point (25).

Figure 5:
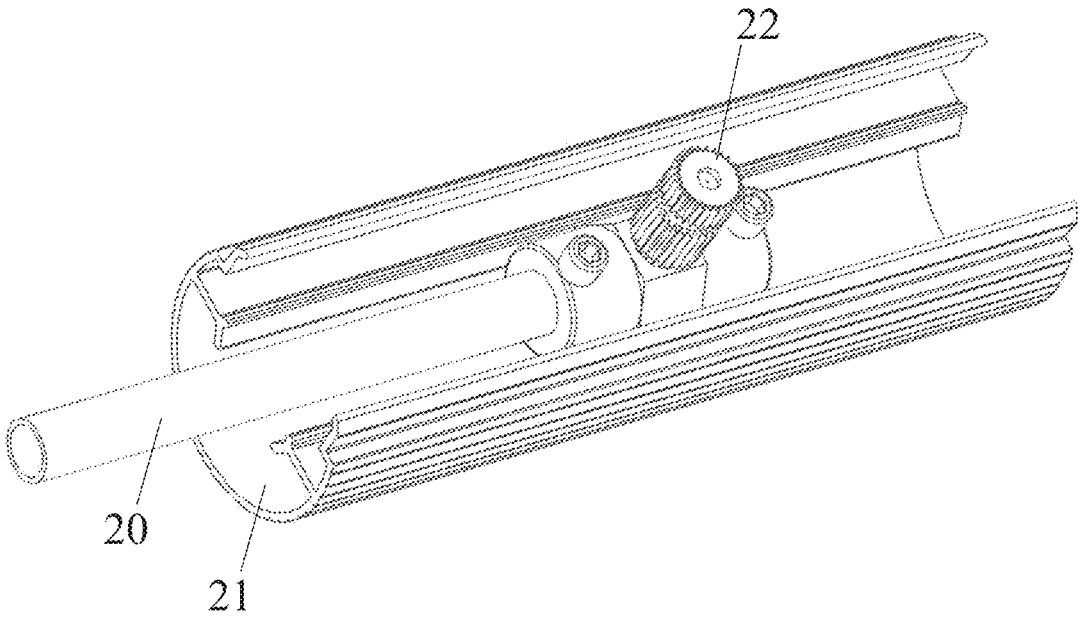
FIG. 5 is a perspective view of a nozzle pipe (20), a nozzle (22) installed on the nozzle pipe (22), and a nozzle pipe enclosure (24) partly enclosing the nozzle pipe (20) and the nozzle (22).
Figure 6:
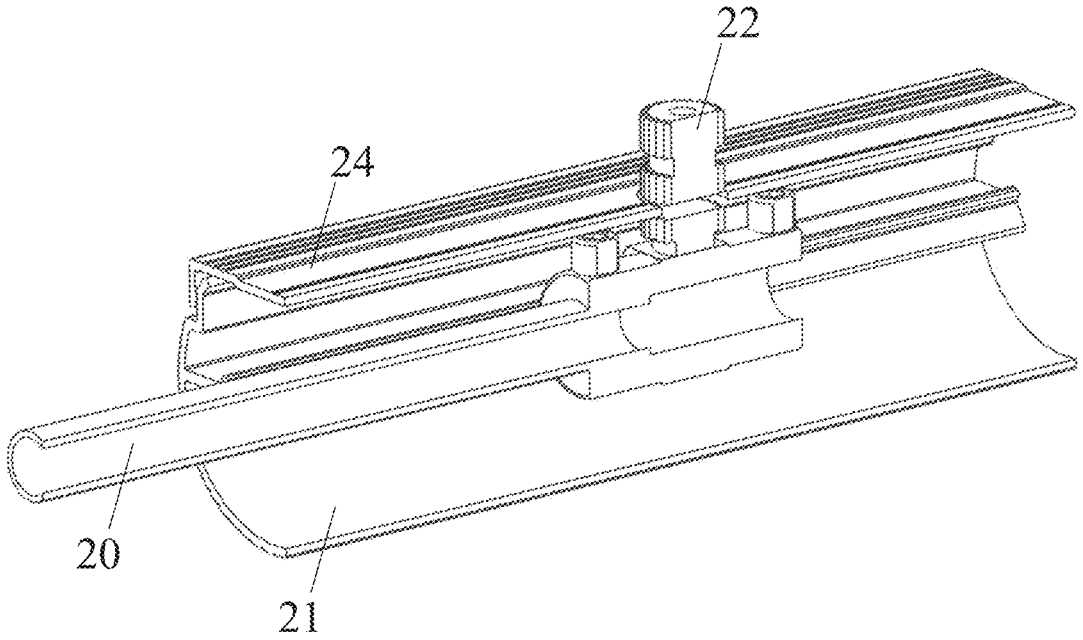
FIG. 6 is a cross-section view in a longitudinal direction of the nozzle pipe enclosure (21) as seen in FIG. 5 and with added enclosure cover (24).
Figure 7:
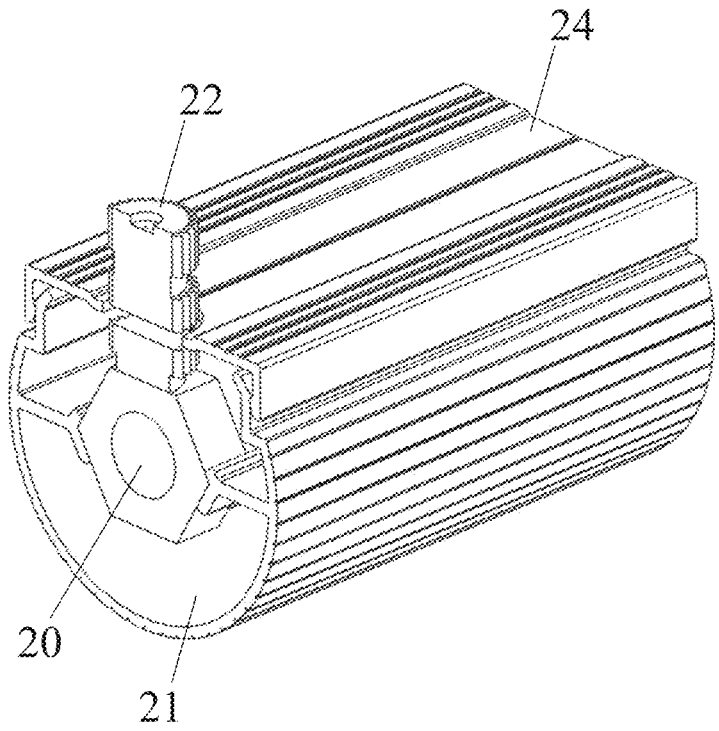
FIG. 7 is a cross-section view in an orthogonal direction of the nozzle pipe enclosure (21) as seen in FIGS. 5 and 6.

FIG. 5 is a perspective view of a nozzle pipe (20), a nozzle (22) installed on the nozzle pipe (22), and a nozzle pipe enclosure (21) partly enclosing the nozzle pipe (20) and the nozzle (22). FIG. 6 is a cross-section view in a longitudinal direction of the nozzle pipe enclosure (21) as seen in FIG. 5 and with added enclosure cover (24). FIG. 7 is a cross-section view in an orthogonal direction of the nozzle pipe enclosure (21) as seen in FIGS. 5 and 6. The nozzle pipe (22) is inserted into the nozzle pipe enclosure (21) partly enclosing the nozzle pipe (22). In order to fully cover the nozzle pipe (20), the enclosure cover (24) is attached to the open side of the nozzle pipe enclosure (21). Said nozzle pipe enclosure (21) and enclosure cover (24) protect the nozzle pipe (22) from a hazardous environment-humidity, heat, salt, external damage, etc.

Figure 8:
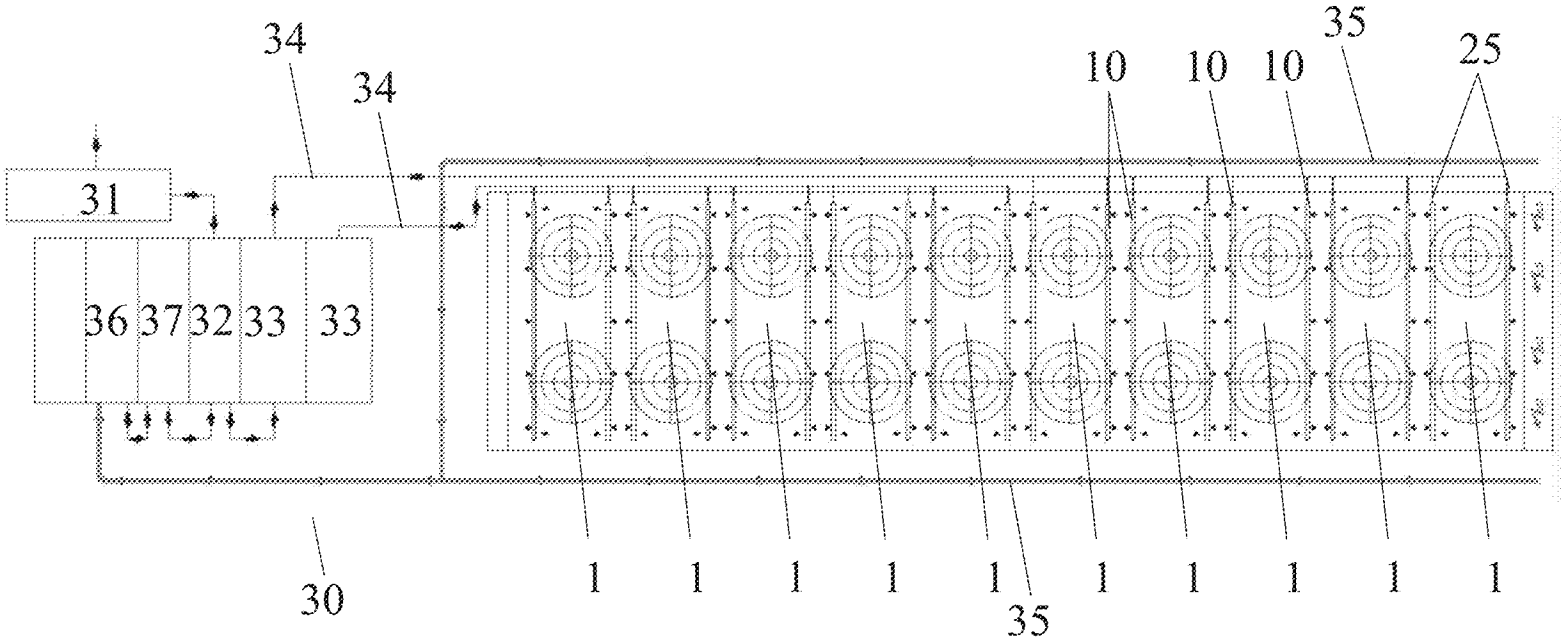
FIG. 8 schematically illustrates the water management unit (30).

FIG. 8 schematically illustrates the water management unit (30). The water management unit (30) is fluidly connected to each water spraying unit (10) through the connection points (25). The presented embodiment of the invention comprises ten V-type air cooled heat exchangers (1) and twenty water spraying units (10)—one water spraying unit (10) on each side of the V-type air cooled heat exchanger (1). The water management unit (30) comprises a water inlet filtration module (31) for filtration of incoming water in the system, an UV and antiscale module (32) fluidly connected to the water inlet filtration module (31) and configured to UV treat and antiscale the water, a high pressure pump (33) fluidly connected to the UV and antiscale module (32) and configured to supply the water to the water spraying unit (10) via a high pressure line (34), wherein a water pressure generated by the high pressure pump (33) is in a range of 60 to 100 bar. In the present embodiment, the water management unit (30) comprises two high pressure pumps (33)—each high pressure pump (33) for five V-type air cooled heat exchangers (1). The water management unit (30) further comprises a drainage (35) configured to collect non-evaporated water, and a recirculating module with a booster pump (36) fluidly connected to the drainage (35) and configured to pump the water from the drainage (35) to the inlet filtration module (31). The water management unit (30) further comprises an auxiliary filtration module (37) fluidly connected to the recirculating module with the booster pump (36) and the UV and antiscale module (32), The auxiliary filtration module (37) is configured to filtrate the water incoming from the drainage (35).

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims, if present.

The invention claimed is:

1. Adiabatic pre-cooling system with V-type air cooled heat exchangers (1), wherein the V-type air cooled heat exchanger (1) comprises two air inlet areas (2) arranged in V-type configuration to each other, an air outlet (3) arranged above two air inlet areas (2) and at least one fan (4) configured to provide an air flow (A) from the air inlet area (2) to the air outlet (3), wherein the system comprises:

an adiabatic panel (5) arranged in front and in parallel to the air inlet area (2) of the V-type air cooled heat exchanger (1) so that the incoming air flow (A) first flows through the adiabatic panel (5) and then through the air inlet area (2) of the V-type air cooled heat exchanger (1) into the V-type air cooled heat exchanger (1);

a water spraying unit (10) arranged in front of the adiabatic panel (5), wherein the water spraying unit (10) comprises a horizontal water spraying sub-unit (11) arranged at a lower edge of the air inlet area (2) and two vertical water spraying sub-units (12) arranged on each end of the horizontal water spraying sub-unit (11) and fluidly connected thereto, wherein the horizontal water spraying sub-unit (11) and two vertical water spraying sub-units (12) are arranged parallel to the adiabatic panel (5);

each water spraying sub-unit (11; 12) comprises a nozzle pipe (20) and at least two nozzles (22) installed on said nozzle pipe (20), wherein the nozzles (22) on the vertical water spraying sub-unit (12) are arranged so that water from the nozzles (22) is sprayed parallel to the adiabatic panel (5) and toward each other, and wherein the nozzles (22) on the horizontal water spraying sub-unit (11) are configured so that the water can be sprayed in the range from a longitudinal direction to a direction of the incoming air flow (A) to a parallel direction to the adiabatic panel (5), a water management unit (30) fluidly connected to the water spraying unit (10) and configured to supply the water to the water spraying unit (10).

2. The adiabatic pre-cooling system according to claim 1, wherein the horizontal water spraying sub-unit (11) comprises 6 to 12 nozzles (22), preferably 8 nozzles (22).

3. The adiabatic pre-cooling system according to claim 1, wherein, the vertical water spraying sub-unit (12) comprises from 2 to 5 nozzles (22), preferably 5 nozzles (22).

4. The adiabatic pre-cooling system according to claim 1, wherein an opening (23) of the nozzle (22) is in the range of 15 to 40 microns.

5. The adiabatic pre-cooling system according to claim 1, wherein the water management unit (30) comprises a water inlet filtration module (31) for filtration of incoming water in the system, an UV and antiscale module (32) fluidly connected to the water inlet filtration module (31) and configured to UV treat and antiscale the water, a high pressure pump (33) fluidly connected to the UV and antiscale module (32) and configured to supply the water to the water spraying unit (10) via a high pressure line (34), wherein a water pressure generated by the high pressure pump (33) is in a range of 60 to 100 bar.

6. The adiabatic pre-cooling system according to claim 1, wherein each water spraying sub-unit (11; 12) comprises a nozzle pipe enclosure (21) partly enclosing said nozzle pipe (20) and an enclosure cover (24) joined with the nozzle pipe enclosure (21) fully enclosing said nozzle pipe (20).

7. The adiabatic pre-cooling system according to claim 1, wherein a distance between the nozzles (22) of the horizontal water spraying sub-unit (11) is generally equal to a distance between the nozzles (22) of the vertical water spraying sub-unit (12).

8. The adiabatic pre-cooling system according to claim 1, wherein the water management unit (30) further comprises a drainage (35) configured to collect non-evaporated water, and a recirculating module with booster pump (36) fluidly connected to the drainage (35) and configured to pump the water from the drainage (35) to the inlet filtration module (31).

9. The adiabatic pre-cooling system according to claim 1, wherein, the water management unit (30) further comprises auxiliary filtration module (37) fluidly connected to the recirculating module with booster pump (36) and the UV and antiscale module (32), wherein the auxiliary filtration module (37) is configured to filtrate the water incoming from the drainage (35).

* * * * *